US006506223B2

(12) United States Patent
White

(10) Patent No.: US 6,506,223 B2
(45) **Date of Patent: *Jan. 14, 2003**

(54) PELLETIZING AND BRIQUETTING OF COMBUSTIBLE ORGANIC-WASTE MATERIALS USING BINDERS PRODUCED BY LIQUEFACTION OF BIOMASS

(75) Inventor: Donald H. White, Tucson, AZ (US)

(73) Assignee: Waste Technology Transfer, Inc., Tucson, AZ (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/802,253

(22) Filed: Mar. 8, 2001

(65) Prior Publication Data

US 2001/0013197 A1 Aug. 16, 2001

Related U.S. Application Data

(63) Continuation-in-part of application No. 09/342,714, filed on Jun. 29, 1999, now abandoned, which is a continuation-in-part of application No. 08/985,399, filed on Dec. 5, 1997, now Pat. No. 5,916,826.

(51) Int. Cl.[7] ..... C10L 5/00; C10L 5/02

(52) U.S. Cl. ..... 44/551; 552/553; 552/564; 552/569; 552/579; 552/593

(58) Field of Search ..... 44/593, 552, 564, 44/553, 567, 569, 551, 578, 596

(56) References Cited

U.S. PATENT DOCUMENTS

| | | | |
|---|---|---|---|
| 421,878 | A | 2/1890 | Wiesner |
| 829,042 | A | 8/1906 | Wagner |
| 851,381 | A | 4/1907 | Robeson |
| 1,503,304 | A | 7/1924 | Damon |
| 1,724,393 | A | 8/1929 | Carpenter et al. |
| 1,871,104 | A | 8/1932 | Willard |

(List continued on next page.)

OTHER PUBLICATIONS

Articles from the Proceedings vol. II, First Biomass Conference of the Americas: Enery, Environment, Agriculture, and Industry Joyner et al., "MSW and Biomass to Liquid Fules by Packard Liquefaction Plants" p. 964–, Boocock et al, "Light Hydrocarbon Liquids From Dry Raw Sewage Sludge," p. 978– , Aug. 30, 1993.

*Primary Examiner*—Margaret Medley
(74) *Attorney, Agent, or Firm*—Antonio R. Durando; Durando Birdwell & Janke, PLC

(57) ABSTRACT

A fuel pellet is produced by the combination of organic waste material with a binder obtained by direct liquefaction and/or fast pyrolysis of biomass material. Direct liquefaction and fast pyrolysis are carried out according to known liquefaction processes. The liquefied bio-binder base is mixed with additives, if desired, such as petroleum asphalt and cross-linking agents, in order to modify its characteristics to meet specific needs of particular applications, and the resulting mixture is mixed with organic-waste material preheated to 100° C. or more and allowed to react at about 150–200° C. Combustible extenders and fillers, reinforcing fibers, and cross-linking agents may be mixed with the organic material or the bio-binder base to provide additional specific properties to the mixture. The resulting well mixed mass is then pelletized or otherwise molded in conventional equipment.

30 Claims, 3 Drawing Sheets

U.S. PATENT DOCUMENTS

| | | | | |
|---|---|---|---|---|
| 1,890,491 | A | 12/1932 | Bergius et al. | |
| 3,073,751 | A | 1/1963 | Gorin et al. | 202/26 |
| 3,829,297 | A | 8/1974 | Crawford | 44/15 |
| 3,966,427 | A | 6/1976 | Herment | 44/19 |
| 4,045,537 | A | 8/1977 | Hrishikesan | 423/119 |
| 4,152,119 | A | 5/1979 | Schulz | 44/1 |
| 4,169,711 | A | 10/1979 | Anderson | 44/26 |
| 4,219,519 | A | 8/1980 | Goksel | 264/82 |
| 4,326,854 | A | 4/1982 | Tanner | 44/10 |
| 4,389,218 | A | 6/1983 | Pike | 44/6 |
| 4,405,331 | A | 9/1983 | Blaustein et al. | 44/1 |
| 4,497,661 | A | 2/1985 | Valenti | 75/256 |
| 4,529,407 | A | 7/1985 | Johnston et al. | 44/21 |
| 4,586,936 | A | 5/1986 | Schaffer et al. | 44/10 |
| 4,618,347 | A | 10/1986 | Watt et al. | 44/16 |
| 4,738,685 | A | 4/1988 | Goleczka et al. | 44/15 B |
| 4,762,527 | A | 8/1988 | Beshore et al. | 44/51 |
| 4,863,485 | A | 9/1989 | Schaffer et al. | 44/16 |
| 5,009,671 | A | 4/1991 | Franke et al. | 44/15 B |
| 5,089,540 | A | 2/1992 | Armbruster et al. | 523/213 |
| 5,244,473 | A | 9/1993 | Sardessal et al. | 44/553 |
| 5,250,080 | A | 10/1993 | Michelena et al. | 44/575 |
| 5,562,743 | A | 10/1996 | Daugherty et al. | 44/589 |
| 5,635,069 | A | 6/1997 | Boss et al. | 210/609 |
| 5,916,826 | A | 6/1999 | White | 44/551 |

PELLETIZING AND BRIQUETTING OF COMBUSTIBLE ORGANIC-WASTE MATERIALS USING BINDERS PRODUCED BY LIQUEFACTION OF BIOMASS

RELATED APPLICATIONS

This is a continuation-in-part application of U.S. Ser. No. 09/342,714, filed Jun. 29, 1999, abandoned, which is a CIP of U.S. Ser. No. 08/985,399, filed Dec. 5, 1997, U.S. Pat. No. 5,916,826.

BACKGROUND OF THE INVENTION

1. Field of the Invention

This invention is related in general to the field of pelletizing and briquetting of combustible materials. In particular, the invention concerns the use of liquefied biomass as a reactive binder for organic-waste material.

2. Description of the Related Art

Enormous quantities of wood waste material are produced both by recycling and as byproducts of industrial and commercial activity. For example, it is estimated that about 5,000 lumber mills in the U.S. continuously generate sawdust and wasted wood at a rate of approximately ten percent of the processed lumber. Similarly, over 1,100 cotton gins in the U.S. produce gin waste in the form of cotton stalks, mostly lignocellulose, which have to be plowed into the ground in order to minimize insect damage. The lignocellulosic stalks of corn, wheat, other grains, hays, grasses, sugar cane bagasse, and soybeans are also produced in large quantities but, with the exception of sugar cane bagasse, they are largely left to waste because of the expense involved in collecting them. Much potentially useful biomass is also available from dead wood in forests, which is typically destroyed by insects, microorganisms, or fires. Further, national forests have accumulated an excess of living biomass in the form of dense small trees, shrubs and pine needles that should be removed to save older, large trees from being destroyed in catastrophic wild forest fires. Moreover, solid waste from municipal sewage treatment plants consists of a sludge that contains organic material and toxic constituents that constitute a disposal problem. Similar wastes are produced by nearly 100,000 dairy operations in the U.S., which must continuously dispose of a mixture of bedding and manure, all organic material. Additional organic-waste material is produced in large quantities as waste from cattle, hog, chicken and turkey farms. Finally, it is estimated that approximately 280 million automotive tires are discarded annually in the U.S., ranging from 20 to 1,000 pounds in weight, which also represents a serious, continuing disposal problem.

Most of this waste material is currently being disposed of in landfills around the world. Approximately 300 million tons of solid waste is placed in about 3,500 landfills around the U.S. alone every year, about 70–80 percent of which is organic matter. Thus, it is clear that the magnitude of these organic wastes constitutes a serious environmental problem. As a result, increasingly stringent regulation of waste disposal practices are being imposed to satisfy environmental standards. Therefore, reutilization of these materials has become an important component of prudent industrial policy.

A related patent, U.S. Pat. No. 5,916,826, hereby incorporated by reference, describes a process for binding coal fines in briquettes based on the discovery that biomass liquefaction products are very reactive and can be used to bind active groups in waste-coal fines. That invention did not disclose a method for converting these additional sources of biomass waste material, such as from forests, lumber mills, dairies, cotton gins, farms, and municipal waste sludge, into combustible briquettes. The present invention is based on further work with liquefied biomass and the discovery that it can be used to produce useful, combustible agglomerates of waste material.

BRIEF SUMMARY OF THE INVENTION

The primary goal of this invention is the use of liquefied biomass as a binder for agglomerating combustible waste material to produce a useful combustible product.

Another goal is the use of a liquefied biomass that is itself produced from waste material, thereby reducing the overall cost of the raw materials constituting the final product.

Still another goal of the invention is a binding process that takes advantage of the reactive nature of liquefied biomass material to produce a stable agglomerate in the form of a pelletized, briquetted, or molded product.

Finally, an objective of the invention is a binder that contains reactive groups which can be judiciously used to improve bonding with particular kinds of combustible waste material.

According to these and other objectives, the present invention consists of the combination of organic combustible waste material with a liquid binder produced by the direct liquefaction or fast pyrolysis of biomass material. Such liquefied biomass is produced according to known liquefaction processes in the absence of oxygen at typical temperatures between about 230 and 370° C. (about 450–700° F.) and typical pressures between 200 and 3,000 psi. Alternatively, a liquid biomass product may also be produced by the process of fast pyrolysis, which is instead carried out at atmospheric pressure and at temperatures of 400–600° C. (about 205–315° F.) with a residence time of about two to five seconds, or at temperatures greater than 600° C. with residence times of less than 0.5 seconds.

If desired, the liquid biomass so produced by either direct liquefaction or fast pyrolysis may be mixed with additives (such as the heavy ends of fast pyrolysis, petroleum asphalts, natural bitumens, oils from tar sands, oils from shales, heavy ends of coal liquefaction, petroleum pitch, and petroleum coke derived from petroleum delayed coking processes) in order to modify its characteristics to meet specific needs of particular applications, and the resulting mixture is blended with the organic-waste material of choice. Depending on the nature of the waste material used, it may be advantageous to preheat it to enhance the binding reaction with the liquid biomass. While in some cases a preheating step up to 425° C. (about 800° F.) has been found to be advantageous, a preheat temperature in the 100 to 200° C. range (250–400° F.) is normally sufficiently beneficial for the purposes of the invention. Combustible extenders and fillers, reinforcing fibers, and cross-linking agents may also be mixed with the waste material prior to combination with the binder to provide additional specific properties to the mixture. The resulting well mixed mass may then be pelletized by the application of pressure or molded to a desired shape in conventional equipment.

Various other purposes and advantages of the invention will become clear from its description in the specification that follows and from the novel features particularly pointed out in the appended claims. Therefore, to the accomplishment of the objectives described above, this invention consists of the features hereinafter illustrated in the drawings, fully described in the detailed description of the preferred embodiments and particularly pointed out in the claims. However, such drawings and description disclose only some of the various ways in which the invention may be practiced.

DESCRIPTION OF THE PREFERRED EMBODIMENTS OF THE INVENTION

Figure 1:
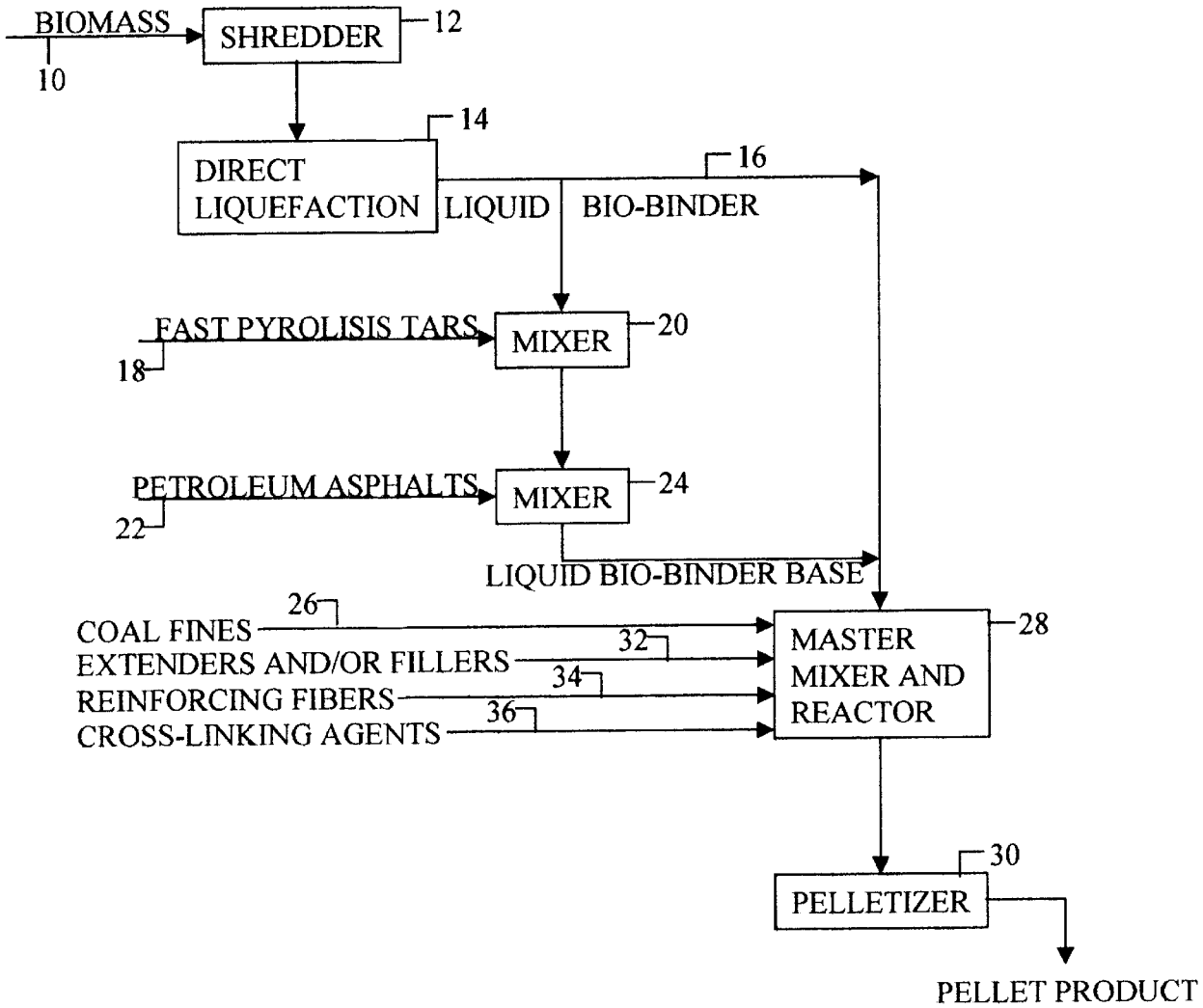
FIG. 1 illustrates the process of the invention disclosed in U.S. Pat. No. 5,916,826, including the step of producing a specific binder formulation for producing a pelletized coal product from liquefied biomass and coal fines.

This invention is based on the idea of utilizing liquid biomass produced by direct liquefaction or fast pyrolysis as a binder for particles of combustible organic materials to produce concrete masses in the form of usable pellets, briquettes, or molded agglomerates. As disclosed U.S. Pat. No. 5,916,826, I discovered that unstabilized crude products derived from the direct liquefaction of biomass can be made to react with chemical groups on the surface of coal fines at elevated temperatures. Thus, that disclosure showed that these reactive materials can be used advantageously as binders for briquetting coal fines, producing a coal briquette product with unique properties which, in combination with appropriate additives, can be tailored to enhance the characteristics of specific coal fines and to meet the needs of particular coal markets.

As an extension of the work disclosed in the referenced patent, I discovered that such unstabilized crude products derived from the direct liquefaction of biomass can also be made to react with chemical groups in wood and other organic-waste materials. I further discovered that similar reactivity is present in liquid biomass derived from fast pyrolysis of organic matter. Hence, this invention is based on the idea of advantageously using such liquid biomass products as a binder for incorporating combustible wastes into useful molded products.

As used in this disclosure, the term biomass refers in general to any organic-waste material that has been found to be suitable for conversion to liquid form by a process of liquefaction or fast pyrolysis. In particular, and without limitation, such biomass and organic-waste material are defined as organic material containing various proportions of cellulose, hemicellulose, and lignin; to manures; to protein-containing materials, such as soybeans and cottonseeds; and to starch-containing materials, such as grain flours. Hemicellulose is a term used generically for non-cellulosic polysaccharides present in wood. Finally, organic-waste material is intended to include rubber waste material (such as from tires), and bituminous wastes (such as from coal fines).

The term liquefaction, as used in this disclosure with reference to biomass, refers to direct-liquefaction and fast-pyrolysis processes by which biomass is converted into liquid form. Such processes are well known in the art. For convenience the liquid materials formed by liquefaction are referred to in the art and herein as "liquefied" materials, as distinguished from "liquified" materials" formed by condensation from a vapor state. Direct-liquefaction processes provide high yields of liquid products from biomass by the application of sufficient pressure, typically in the range of 200 to 3,000 psi, in the absence of air and at approximate temperatures in the 230–370° C. range. Fast pyrolysis processes, which also produce a liquid product from biomass, are instead carried out at atmospheric pressure and at temperatures of 400–600° C. with a residence time of about two to five seconds, or at temperatures greater than 600° C. with residence times of less than 0.5 seconds. It is noted that, in contrast, indirect-liquefaction processes first convert biomass to gases, which are then caused to react catalytically to produce liquids. The scope of this invention does not include liquids obtained by indirect liquefaction. As used herein, the term liquefaction is intended to refer either to the process of direct liquefaction, or to the process of fast pyrolysis of biomass, or to any other process that produces a liquefied biomass that consists of a thermoplastic liquid that contains reactive groups which can be used to bond with combustible waste material at temperatures grater than about 60° C. Accordingly, the terms liquefied biomass and bio-binder are intended to refer to the raw liquid products obtained by these processes for use as a binder for combustible organic-waste material, according to the process of the invention, prior to any specific formulation by the addition of other components. The term bio-binder base refers to a binder derived from a bio-binder after specific formulation for a particular purpose, such as by the addition of other components.

The invention described in the referenced application is based on the known presence of reactive hydroxyl groups (—OH), carboxyl groups (—COOH), carbonyl groups (=CO), and related reactive groups in the surface of coal particles. The present invention is based on the fact that all organic-waste materials also contain reactive chemical groups. Lignocellulosic material, the major component of trees, shrubs, stalks, grasses, and growing vegetation in general, contains cellulose and hemicellulose molecules with two reactive hydroxy groups. These groups react readily with other organic groups, especially aldhehydes. Therefore, such organic-waste material is suitable raw material for combination with the bio-binder produced by the processes of liquefaction of biomass (either direct liquefaction or fast pyrolysis). In the case of wood, the waste material can be further improved for reaction with liquefied biomass by known chemical-modification processes.

The liquefied biomass produced by direct liquefaction can have different chemical compositions and properties, depending on the liquefaction conditions. For example, different tar-like products were obtained by the direct liquefaction of Douglas Fir wood operating at about 3,000 psi and temperatures in the 324–350° C. range (about 615–660° F.) in the presence of a synthesis gas (67% carbon monoxide and 33% hydrogen). The resulting products varied from 3.2 to 18.1 wt percent in oxygen content and from 13,300 to 16,530 Btu/lb in heating value. Obviously, different raw materials would also yield different liquefied biomass, which may vary in consistency from tar-like products to light oils. As one skilled in the art would readily appreciate, similar differences exist in the liquefied biomass obtained by fast pyrolysis.

A good source of bio-binder from biomass is the direct liquefaction of biomass by the Pittsburgh Energy Research Center (PERC) process, a successor to the Bureau of Mines facility where the initial biomass liquefaction research was conducted. The process utilizes a continuously stirred tank reactor system, aided by synthesis gas injection (carbon monoxide and hydrogen) and sodium carbonate catalyst. According to this process, shredded Douglas Fir softwood containing about 42 weight percent oxygen on a dry basis can be converted to a wood-derived tar with a heating value of about 15,000 Btu per pound and an oxygen content reduced to about 8–12 weight percent. This unstabilized tar was found to be reactive with organic-waste material at temperatures above about 60° C. (140° F.).

Thus, it is well known that any biomass, especially lignocellulosic material, can be converted into a heavy tar or oil by applying heat and pressure in the process, while retaining most of the heating value of the biomass feedstock in a more concentrated form. Water and carbon dioxide are driven off the biomass to make it more like a petroleum crude oil. For the purposes of this invention, the temperature and pressure can be adjusted to give a very viscous liquid product, which can be pumped at 150° C. (about 302° F.) but is a brittle solid at ambient temperatures. Test data show that the high molecular weights of the cellulosic and hemi-cellulosic portions of the biomass are degraded to lower molecular weight aromatic and aliphatic ethers, alcohols, hydrocarbons and a variety of other chemicals.

According to the invention, the bio-binder base composition can be tailored to a specific source of organic wastes by proper blending with (a) other, less viscous materials, which can also be reactive materials; (b) other chemicals to react with organic acids, aldehydes and hydroxy compounds in the bio-binder mass; (c) unburned volatiles; (d) other binder-forming polymers; (e) cross-linking agents; and/or (f) agents to reinforce the final bio-binder base formulation.

Thus, according to the invention, the bio-binder obtained from liquefaction of biomass, whether in its original form or modified to a specific formulation, is combined by chemical reaction with organic-waste material at temperatures above 60° C., preferably in the 90 to 260° C. range (about 200 to 500° F.) if coal fines are also included, and atmospheric pressure. Depending on the nature of the organic-waste material used with the bio-binder base, the latter is preferably just blended or first sprayed and then mixed with the organic-waste material. Any amount of bio-binder mass in excess of about 3 wt percent was found to be acceptable for a combustible product incorporating organic-waste material. It is noted that while the lower bio-binder content limit is important in order to ensure sufficient coverage of the surface of the organic-waste particles to enable their agglomeration, the upper limit is only affected by economical considerations. At room temperature the bio-binder is a very good solid fuel by itself; therefore, even in mixtures where its content approaches 100 percent, the resulting agglomerate is an excellent combustible product. Since the bio-binder mass itself has a high Btu content, usually higher than that of the organic-waste material it is binding, the heating value of the resulting agglomerate is not materially altered by using a high percentage of bio-binder. The adhesive properties of the mix are similarly retained; therefore, other than cost, there is no disadvantage to using high percentages of bio-binder.

Various extenders, fillers, etc, are also used to formulate a lower-cost bio-binder base with essentially the same reactive and binding properties of crude liquefied biomass. Obviously, the percentages of the various components vary with the nature of the bio-binder and organic-waste material used, as one skilled in the art would recognize and be able to optimally determine. The mixture is blended for at least one to five minutes at the operating temperature to promote binding reactions to occur between the bio-binder and the organic-waste particles. Then the mixture is conveyed to a conventional pelletizer and processed according to well known pelletizing methods. Alternatively, the mixture is molded to a desired shape. It is noted that the binding reactions between the organic-waste particles and the bio-binder are known to continue during and after the pelletizing process.

It has also been discovered that the bio-binder of the invention can be treated in various manners without losing its basic advantage of being a reactive binder. For example, the bio-binder can be extended by Type IV roofing asphalt, which acts as a diluent and lowers the viscosity of the formulated binder; extended by petroleum waxes, to decrease the creep of the binder; extended by low-molecular weight polyolefin polymers (high density polyethylene, linear polyethylene, polypropylene), to reduce the viscosity of the binder for easier spraying while retaining a high btu content; and extended by crude calcium stearates, as lubricants to facilitate the release of the agglomerate from the mold after molding or pelletization.

In addition, when the organic-waste material includes coal fines, the bio-binder can be advantageously mixed with other waste materials high in phenolics, such as tannins, lignin, wood bark, etc. These can either be (a) added as binder diluents prior to pelletizing or molding, or (b) put through the liquefaction process. In either case, this increases the hydroxy group content of the binder for reaction with the coal fines just prior to pelletization or molding. The binder can also be mixed with other waste-derived products, rich in aldehydes, such as crude furfural, derived from oat hulls, corncobs, wheat straws, and other sources of hemi-cellulose. As one skilled in the art would know, special reaction conditions are required if significant furfural amounts or other aldehydes are to be utilized.

The binder can also be mixed with a fraction of the light tars derived from charcoal production and with crude oils obtained by fast pyrolysis in order to provide additional reactive groups (derived from aldehyde and phenol radicals) to give more adhesion to the binder and allow a reduction in the amount of bio-binder utilized. Similarly, it can be mixed with degraded waste rubber tires; or extended by nearly pure combustible materials, such as shredded newsprint, cardboard, pine needles, tree bark, tannins, lignins, oat hulls, wheat straws, wheat flours, corn flours, partially-degraded lignite coal, and partially-degraded peat, and various waste organic sludges.

Finally, the binder can also be cross-linked (just prior to pelletizing or molding) by the addition of conventional phenol/formaldehyde, conventional urea/formaldehyde, conventional isocyanates, maleic anhydride (interfacial improvement), glycerol, and ethylene glycol (from waste anti-freeze); or reinforced by the addition of chopped natural or synthetic polymeric fibers, such as waste cotton, polypropylene upholstery, chopped carpets (polyesters/nylons), and chopped auto fluff material such as foam cushions.

FIG. 1 illustrates the process of formulating a specific bio-binder base and producing coal pellets from coal fines according to the invention described in U.S. Pat. No. 5,916,826. Biomass material 10 is sized in a shredder 12 and processed by direct liquefaction in a liquefaction reactor 14 to produce a liquified bio-binder 16. As understood by those skilled in the art, the molecular weight and stage of reactivity for the bio-binder 16 can be manipulated by controlling the operating conditions in the direct-liquefaction process and in some cases by specifying the type of biomass 10 used, which can consist of wood, other lignocellulosic materials, lignin, waste paper, agricultural organic wastes and/or manures.

The bio-binder 16 can be modified by the addition of a portion of fast pyrolysis tars 18 in a first mixer 20; however, this modification is optional and can be used to obtain certain desired physical and chemical properties of the liquefied binder, such as providing additional reactive groups or replacing a portion of the biomass material with less expensive tars without loss of reactivity. It is noted that the fast pyrolysis tars referred to here are not produced from biomass, but rather from pyrolysis of other raw materials. Similarly, another option is the addition of a portion of petroleum asphalt 22 in another mixer 24. While the mixing operations of mixers 20 and 24 may be combined in a single unit, under certain circumstances it may be advantageous or desirable to keep them separate, such as for better control of viscosity and temperature and/or for good mixing conditions. The liquefied bio-binder from direct liquefaction (or as formulated in mixer 22 or mixer 24) can be used directly with coal fines 26, sprayed or otherwise combined with the coal and allowed to react in a master mixer 28 at a temperature and for a time sufficient for the active groups in the bio-binder base to react and bond with active groups in the surface of the coal fines. In order for such reactions to occur, a minimum temperature of about 60° C. is required (about 140° F.), higher temperatures being preferred, which can be achieved by preheating the entire coal or binder mass prior to contact, or by heating the mixture while stirring after a very short contact time. While the minimum temperature of 60° C. is considered critical for a reaction between the bio-binder base and the coal particles under these conditions, it is understood that the reaction may be caused to occur at a lower temperature by the addition of catalysts or other chemicals capable of promoting the affinity between the reactants. Therefore, the scope of the invention encompasses lower temperatures as well.

Since the reactive sites are only at the surface of the coal particles, it is not necessary to heat the entire mass of material; rather, it is more economical and efficient to provide sufficient heat to reach the preferred reaction temperature of about 150 to 205° C. (about 300–400° F.) at the surface of the coal fines only. This is advantageously achieved by heating both the coal fines and the liquid bio-binder base. After sufficient reaction time (typically about 1 minute) is allowed in reactor/mixer 28 for a cohesive mixture to be formed, the material is pelletized by the application of pressure in a conventional coal pelletizer 30.

Another option disclosed in the referenced patent is the modification of the coal fines characteristics by the addition of certain desired solid materials, which may include without limitation extenders and/or fillers 32 (such as plastic powder or soybean flour, used to change the particle size distribution of the coal fines), and/or fibers 34 (used to reinforce the structure of the pellet). Cross-linking agents 36 can also be utilized for enhancing certain physical characteristics (such as providing thermosetting properties, increasing the strength of the pellet, or providing brittleness for subsequent repulverization at power-plant locations). I found that all of these formulating steps can be taken without losing the inherent reactive qualities of the bio-binder 16 and its ability to react with the coal fines to produce a superior coal pellet.

Figure 2:
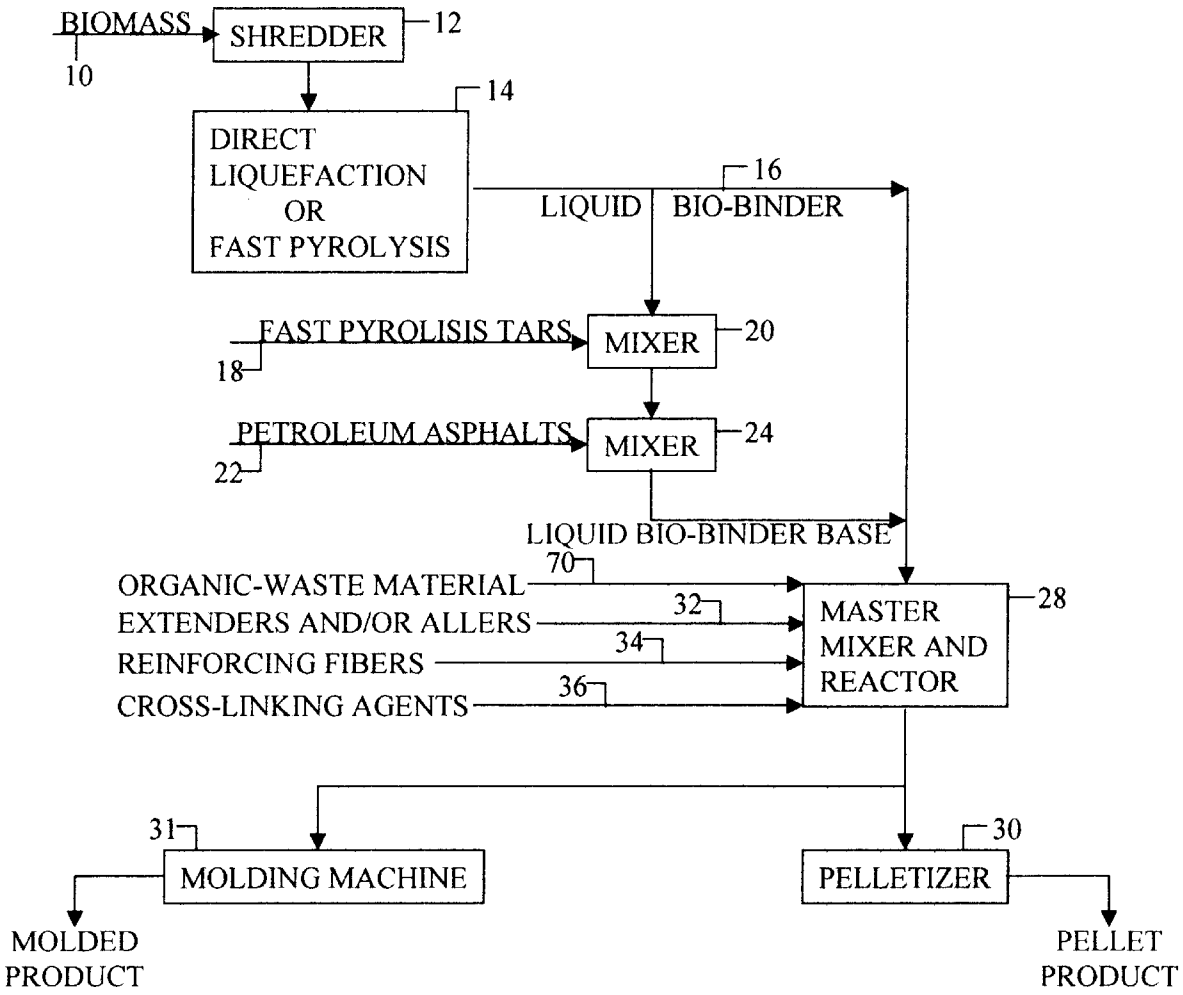
FIG. 2 illustrates the process of the present invention to produce a pelletized or molded product by binding organic-waste material with a specific binder formulation.

FIG. 2 illustrates the process of formulating a specific bio-binder base and producing organic-waste pellets from organic-waste material according to the extended scope of the invention covered by this disclosure. As already illustrated also in FIG. 1, biomass material 10 is processed by direct liquefaction or fast pyrolysis in a liquefaction reactor 14 to produce a liquified bio-binder 16. The bio-binder 16 can again be modified by the addition of a portion of fast pyrolysis tars 18 in a first mixer 20; and/or a portion of petroleum asphalt 22 in another mixer 24. The mixing operations of mixers 20 and 24 may be combined in a single unit, if advantageous or desirable. The resulting liquefied bio-binder (or bio-binder base, as further formulated in mixer 22 or mixer 24) can then be used directly to bind the organic-waste material 70. The blending step is carried out by spraying the liquefied bio-binder base on the organic-waste material in a master mixer 28, and then by blending the sprayed material and allowing it to react, at a temperature and for a time sufficient for the active groups in the bio-binder to react and bond with active groups in the organic-waste material. Alternatively, the spraying step may be skipped and the two components are blended directly in the master mixer 28 and allowed to react under appropriate temperature and residence-time conditions for the binding reaction to occur.

If coal fines are included in the organic-waste material 70, the same reaction temperatures detailed above apply. If, on the other hand, coal fines are not included in the organic-waste material, the same minimum temperature of about 60° C. is required (about 140° F.), higher temperatures being preferred, but a maximum temperature of about 200° C. (about 390° F.) is desirable in order to avoid degradation of the wood. These temperatures can also be achieved by preheating the organic waste and/or the bio-binder base prior to contact, or by heating the mixture while stirring after a very short contact time. As similarly explained before with respect to coal fines, the minimum temperature of 60° C. is considered critical for a reaction between the bio-binder base and the organic-waste material under the described conditions, but it is understood that the reaction may be caused to occur at a lower temperature by the addition of catalysts or other chemicals capable of promoting the affinity between the reactants. Therefore, the scope of the invention should not be limited to this minimum temperature. After sufficient reaction time (in the order of 1 minute) has elapsed for a cohesive mixture to be formed in the reactor/mixer 28, the material is pelletized by the application of pressure in a conventional coal pelletizer 30 or molded in a standard molding machine 31.

Figure 3:
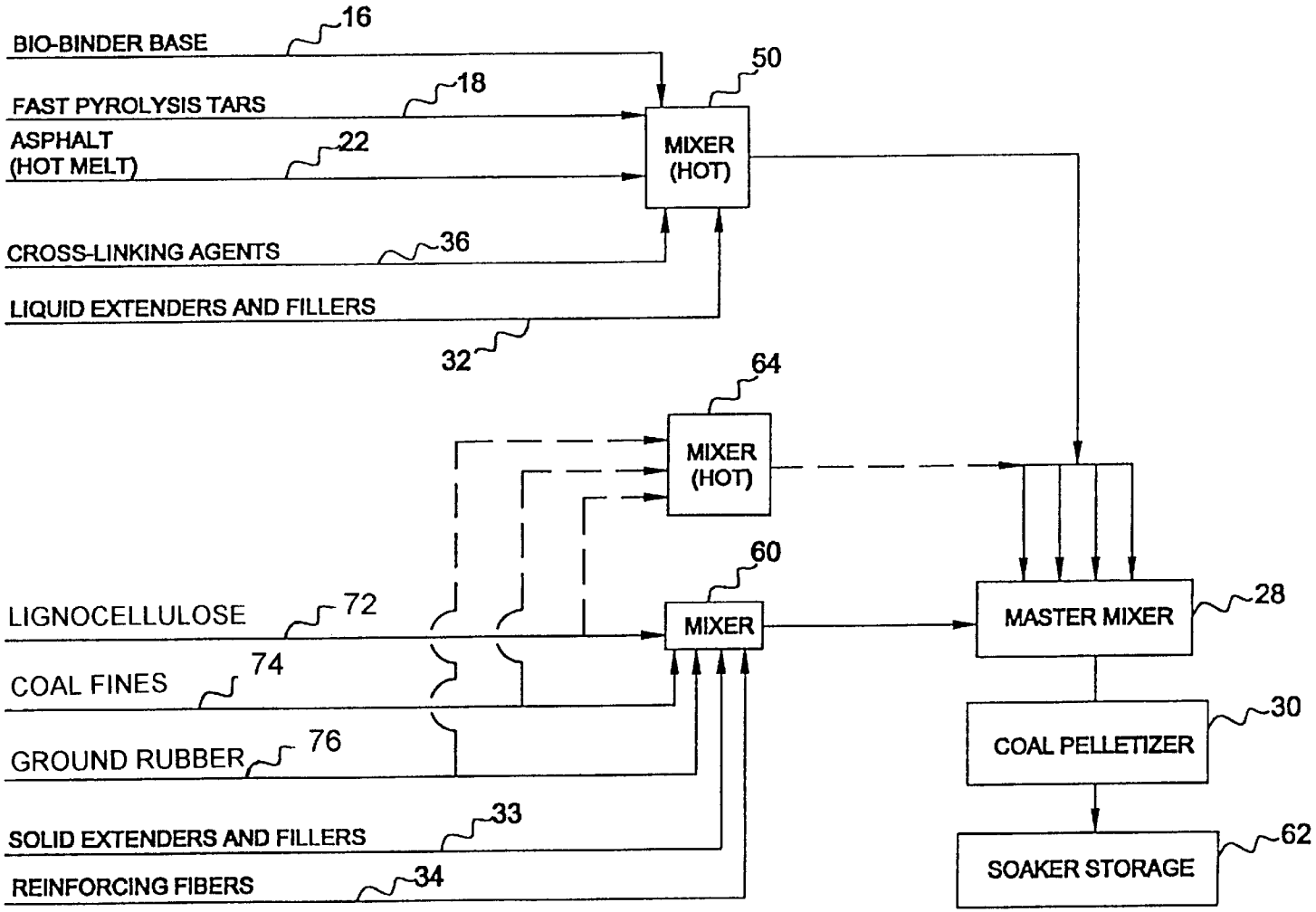
FIG. 3 illustrates a method of mixing all solid feedstock components in one mixer and all liquid feedstock components in a second mixer, and then blending these two mixtures in a master mixer prior to pelletizing or molding.

FIG. 3 illustrates a method of mixing all solid feedstock components in one mixer and all liquid feedstock components in a second mixer, and then blending these two mixtures in a master mixer prior to pelletizing or molding. Various feedstocks may be blended with the bio-binder of the invention to enhance its properties prior to mixing with organic-waste material. All liquid feedstocks, such as the bio-binder 16 (at a temperature greater than about 60° C.; this temperature could be reduced by the use of solvents such as light asphalt, alcohol, etc.), pyrolysis tars 18, hot asphalt 22, cross-linking agents 36, and/or liquid extenders and fillers 32, are blended and mixed in one individual mixer 50. In a separate operation, all solid organic-waste feedstocks, such as lignocellulosic stocks 72, coal fines or other bituminous material 74 and ground rubber material 76, solid extenders and fillers 33 and/or reinforcing fibers 34, are blended and mixed in a second individual mixer 60. The liquid mix from mixer 50 is sprayed upon the solid mix from mixer 60 and allowed to react in a master mixer 28 prior to dropping into a pelletizer or molding machine 30.

The reaction of the bio-binder of the invention with the organic-waste material 72, 74, 76 takes place in the master mixer 28, in the pelletizer 30, and in the soaker storage 62.

If additional residence time for these reactions of the bio-binder base with the organic-waste material is needed, the organic waste can be pre-heated in a third intermediate mixer 64 and then mixed with the bio-binder base mixture prior to conveying to the master mixer 28.

The following examples illustrate the invention with regard to organic-waste material.

EXAMPLE 1

This example illustrates the formulation of a fuel for electrical power plants consisting mostly of waste coal fines but also including waste material from wood and used tires. It is formulated to yield a brittle but cohesive briquette for shipping to power plants as a mixture with lump coal. The briquette is then pulverized on site for use as a fuel in powder form. The brittle property of the briquette fuel facilitates the process of grinding it with lump coal for use at power plants.

A bio-binder produced by the PERC liquefaction process, using Douglas Fir sawdust, was poured as a hot liquid into stainless steel trays and allowed to solidify as "pancakes" about 6–8 inches in diameter and about ¼–½ inch in thickness. This PERC bio-binder was modified to produce a desired bio-binder base by the addition of roofing asphalt as follows:

| | |
|---|---|
| PERC Bio-binder | 700 grams |
| Type IV Roofing Asphalt | 300 grams |
| PERC Bio-Binder Base | 1000 grams |

The bio-binder base was thoroughly mixed and heated in metal cans on electrical hot plates to temperatures of about 175–205° C. (about 350–400° F.). In addition, a wood-derived oil produced by a fast pyrolysis process was used as an extender of the bio-binder base. The bio-binder base and the pyrolysis oil were pre-heated and mixed at about 180° C. (about 355° F.).

Developed at the University of Waterloo, Ontario, Canada, this particular fast pyrolysis process operates at atmospheric pressure and 450–490° C. with a residence time of about 0.5 seconds. For example, Western Hemlock sawdust processed under the above conditions produces a liquid-phase product with a variety of components, including the following:

| | |
|---|---|
| Levoglucosan | 2.5% |
| Hydroxyacetaldehyde | 10.6% |
| Formaldehyde/formic acid | 4.0% |
| Acetol | 3.4% |
| Pyrolytic Lignin | 19.9% |

This wood-derived oil can be used not only as an extender for a bio-binder base, but also as a bio-binder by itself according to the invention for reaction with solid organic material because it has a high concentration of hydroxyacetaldehyde, organic acids, and acetols, which can react in the final formulation to give thermosetting and cross-linking properties.

A petroleum refinery byproduct normally known as FCC oil (from fluid catalytic cracker units) was also used as an additional extender of the bio-binder base. Many refineries produce a petroleum residuum from their fluidized catalytic cracker's main column's bottoms that is difficult to dispose of for a profit. Such FCC oil is inexpensive, is a fuel, and reduces the viscosity of liquefied biomass; therefore, it represents a good source of extending material for the bio-binder base of the invention.

Finally, crude furfural was added to the bio-binder base to increase its reactivity. Furfural provides aldehyde groups for reaction with the hydroxy groups in the bio-binder and the organic-waste material; therefore, it is a useful cross-linking agent for this process.

These four constituents were used in quantities designed to produce a formulated bio-binder base with the following composition:

| | |
|---|---|
| PERC Bio-Binder Base | 60 wt % |
| Pyrolysis Oil | 20 wt % |
| FCC Oil | 19 wt % |
| Crude Furfural | 1 wt % |
| Formulated Bio-Binder Base | 100 wt % |

An organic-waste material mixture was then prepared by mixing shredded wood (with about 20 wt % moisture), shredded waste tire rubber (after removal of all steel), and coal fines (with about 10 wt % moisture) in the following proportions:

| | |
|---|---|
| Coal Fines (dry basis) | 85 grams |
| Shredded Wood (dry basis) | 10 grams |
| Ground Rubber | 5 grams |
| Water | 11 grams |
| Total | 111 grams |

These constituents were combined to produce a briquette as follows. The bio-binder base and the pyrolysis oil were pre-heated and mixed, as detailed above. The FCC oil and the crude furfural were pre-heated as a separate stream to about 150° C. (about 300° F.), mixed to the bio-binder base mixture in a spray head and immediately sprayed over the solid organic-waste material feedstock in a stirred reactor. The blended reaction product was then fed into a conventional briquetting machine at a temperature controlled to minimize the vaporization of the crude furfural, which boils at about 161° C. Various proportions of formulated bio-binder base and organic-waste material were used in separate runs, but at least 3 wt % of the formulated bio-binder base (the balance 97 wt % being organic waste) was found to be required to obtain strong briquettes. The range of 3 to 7 wt % formulated bio-binder base was tested, the variation being mainly a function of the type of briquetting machinery used and the characteristics of the organic-waste material.

It is noted that the aldehydes provided in part by the pyrolysis oil and in part by the crude furfural react with all available hydroxy groups in the shredded wood and the bio-binder base. Thus, a strong pellet results which is brittle and can be crushed in conventional crushing machinery used in electric power plants.

As would be obvious to one skilled in the art, the quantities of wood waste and rubber waste utilized by this process can be varied as a function of the characteristics of the power plant in question. Thus, this form of organic waste utilization provides a way for its useful disposal as well as for the manufacture of a valuable fuel product.

EXAMPLE 2

This example illustrates the formulation of a high-volatile stoker coal fuel. The pelletized fuel is preferably formulated to contain about 51 to 60 wt % waste coal fines in order to qualify as a coal.

The bio-binder base formulation and the processing steps followed were the same as described in Example 1, but the organic-waste feedstock was formulated in the following proportions:

| | |
|---|---|
| Coal Fines (dry basis) | 51 grams |
| Shredded Wood (dry basis) | 39 grams |
| Ground Rubber | 10 grams |
| Total | 100 grams |

Because of its combustion characteristics, its sulfur and zinc content, and its availability, it is preferable to keep the ground rubber component in the 3 to 20 wt % range of total weight. The fine-ground rubber derived from used tires is vulcanized; therefore, it does not dissolve in the bio-binder or FCC oil. Again, multiple runs were performed using at least 3 wt % of the formulated bio-binder base with no more than 97 wt % organic waste, and the same range of 3 to 7 wt % formulated bio-binder base was tested successfully with different briquetting machines. It is noted that the same range of proportions between formulated bio-binder base and organic-waste material was used also for Examples 3 and 4 below.

EXAMPLE 3

This example illustrates the formulation of a typical organic-waste fuel, including refuse derived fuel (RDF). RDF is known as a ground mixture of organic materials collected from landfills comprising mostly paper, wood, green waste from landscaping, plastic, and food waste.

Again, the bio-binder base formulation and the processing steps followed were the same as described in Example 1, but the organic-waste feedstock was formulated in the following proportions:

| | |
|---|---|
| Coal Fines (dry basis) | 20 grams |
| Shredded Wood (dry basis) | 30 grams |
| Shredded Paper (dry basis) | 30 grams |
| Shredded RDF (dry basis) | 10 grams |
| Ground Rubber | 5 grams |
| Cotton Stocks | 5 grams |
| Total | 100 grams |

EXAMPLE 4

This example illustrates the formulation of a typical wood fuel. As above, the bio-binder base formulation and the processing steps followed were the same as described in Example 1. The organic-waste feedstock was formulated in the following proportions:

| | |
|---|---|
| Shredded Green Waste (dry basis) | 60 grams |
| Shredded Waste Lumber (dry basis) | 20 grams |
| Shredded Waste Pallets (dry basis) | 10 grams |
| Sawdust (dry basis) | 10 grams |
| Total | 100 grams |

This formulation has the advantage of using organic-waste material that is readily available in every community and is sulfur free, so that it can be marketed as fuel for furnaces.

The following examples deal with formulations that utilize bio-binder bases derived from direct liquefaction and from fast pyrolysis (from the processes described above) and cellulosic organic wastes. The bio-binder base from direct liquefaction referred to in these examples is the raw PERC bio-binder described in Example 1. The bio-binder base from fast pyrolysis is the raw liquefied bio-binder obtained by the University of Waterloo process, also cited in Example 1.

EXAMPLE 5

Formulation (Dry Basis):

| | |
|---|---|
| Bio-Binder Base from Fast Pyrolylsis | 40 grams |
| Shredded Wood | 60 grams |
| Total | 100 grams |

In order to provide a higher Btu solid-fuel briquette, any percentage of shredded wood can be substituted with petroleum coke. This addition would advantageously dispose of excess petroleum coke obtained by petroleum refineries in the production of gasoline, jet fuels and related products. Such a formulation also provides better Btu values and volatile content for combustion.

EXAMPLE 6

Formulation (Dry Basis):

| | |
|---|---|
| Bio-Binder Base from Direct Liquefaction | 80 grams |
| Shredded Wood | 20 grams |
| Total | 100 grams |

This formulation provides a high Btu solid fuel by virtue of the heat content of the bio-binder base (with a resulting Btu value higher than most coal fuels). It is also a high-volume utilization of lignocellulosic wastes, e.g., forest trimmings, waste lumber, landfill wood and transfer-station wood.

EXAMPLE 7

Formulation (Dry Basis):

| | |
|---|---|
| Bio-Binder Base from Direct Liquefaction | 3 grams |
| Lignin | 10 grams |
| Shredded Wood | 87 grams |
| Total | 100 grams |

This formulation illustrates the binding properties of the bio-binder base of the invention.

EXAMPLE 8

Formulation (Dry Basis):

| | |
|---|---|
| Bio-Binder Base from Fast Pyrolysis | 10 grams |
| Shredded Wood | 80 grams |

-continued

| | |
|---|---|
| Ground Rubber | 5 grams |
| Fluidized Catalytic Cracking Bottoms from Petrolum | 5 grams |
| Total | 100 grams |

This formulation provides a high-volume utilization of wood wastes.

EXAMPLE 9

Same as Example 8, except that the 80 grams of shredded wood were replaced by 80 grams of shredded cotton stalks.

EXAMPLE 10

Same as Example 8, except that the 80 grams of shredded wood were replaced by 80 grams of shredded corn stover.

EXAMPLE 11

Same as Example 8, except that the 80 grams of shredded wood were replaced by 80 grams of wheat straw and other grain straw.

EXAMPLE 12

Same as Example 8, except that the 80 grams of shredded wood were replaced by 80 grams of poultry litter.

EXAMPLE 13

Same as Example 8, except that the 80 grams of shredded wood were replaced by 80 grams of animal manure, which had been beneficiated by drying and removal of most of the dirt.

Thus, it has been shown that biomass material can be used advantageously not only to produce an active bio-binder base for preparing coal pellets from coal fines, but also as a constituent of the organic-waste material used as feedstock for agglomeration with the bio-binder base to produce biomass fuel products. A significant advantage of the invention is that the bio-binder base is chemically derived from organic solid wastes and that essentially all additional components that may be used either to formulate binders with specific properties or to manufacture specific organic-waste fuels are derived from materials having little value for other purposes. One of the preferred feedstocks for preparing the bio-binder base is shredded waste wood, from which a very viscous, tar-like, asphalt-like bio-binder base can be prepared. Other advantages of the invention are the improved strength of the pellets derived from the liquefied biomass and the flexibility allowed in the binder formulation for tailoring its characteristics to the properties of the coal-fines or other organic-waste feedstock of interest.

Various changes in the details, steps and components that have been described may be made by those skilled in the art within the principles and scope of the invention herein illustrated and defined in the appended claims. Therefore, while the invention has been shown and described herein in what is believed to be the most practical and preferred embodiments, it is recognized that departures can be made therefrom within the scope of the invention, which is not to be limited to the details disclosed herein but is to be accorded the full scope of the claims so as to embrace any and all equivalent processes and products.

I claim:

1. A process for producing a biomass fuel product from organic-waste material comprising the following steps:

(a) preparing a bio-binder base using a liquefied bio-binder obtained from liquefaction of biomass in the absence of oxygen;

(b) blending the bio-binder base with an organic-waste material at a temperature between 60 and 260° C. to produce a bonding reaction between the bio-binder base and the organic-waste material, thereby yielding a substantially uniform blend; and (c) molding the blend to produce a solid-fuel product;

wherein the bio-binder base constitutes at least about three weight percent of the solid-fuel product.

2. The process of claim 1, wherein said organic-waste material includes a bituminous waste.

3. The process of claim 1, wherein said organic-waste material includes a cellulosic constituent.

4. The process of claim 1, wherein a fast pyrolysis tar is added to the bio-binder base.

5. The process of claim 1, wherein a petroleum asphalt is added to the bio-binder base.

6. The process of claim 1, wherein a liquid extender is added to the bio-binder base.

7. The process of claim 6, wherein said liquid extender includes a fluid catalytic cracker oil.

8. The process of claim 1, further comprising the step of adding a cross-linking agent to the bio-binder base prior to carrying out step (b).

9. The process of claim 1, wherein said organic-waste material includes a component selected from the group consisting of bituminous-waste material, cellulosic material, rubber material, waste organic sludges, or mixtures thereof.

10. The process of claim 1, further comprising the step of adding combustible reinforcing fibers to the organic-waste material prior to carrying out step (b), wherein said combustible reinforcing fibers are selected from the group consisting of natural polymeric fibers, synthetic polymeric fibers, and mixtures thereof.

11. The process of claim 1, wherein step (b) includes spraying the bio-binder base on the organic-waste material.

12. A solid-fuel product produced by the process of claim 1.

13. A solid-fuel product produced by the process of claim 2.

14. A solid-fuel product produced by the process of claim 3.

15. A solid-fuel product produced by the process of claim 4.

16. A solid-fuel product produced by the process of claim 5.

17. A solid-fuel product produced by the process of claim 6.

18. A solid-fuel product produced by the process of claim 8.

19. A solid-fuel product produced by the process of claim 9.

20. A solid-fuel product produced by the process of claim 10.

21. A solid-fuel product comprising:

(a) a bio-binder base obtained from liquefaction of biomass material in the absence of oxygen; and (b) an organic-waste material;

wherein the bio-binder base is at least about three weight percent of the solid-fuel product.

22. The solid-fuel product of claim 21, wherein said organic-waste material includes bituminous waste.

23. The solid-fuel product of claim 21, wherein said organic-waste material includes a cellulosic constituent.

24. The solid-fuel product of claim 21, further comprising a fast pyrolysis tar.

25. The solid-fuel product of claim 21, further comprising a petroleum asphalt.

26. The solid-fuel product of claim 21, further comprising a liquid extender.

27. The solid-fuel product of claim 26, wherein said liquid extender comprises a fluid catalytic cracker oil.

28. The solid-fuel product of claim 21, further comprising a cross-linking agent.

29. The solid-fuel product of claim 21, wherein said organic-waste material includes a component selected from the group consisting of bituminous-waste material, lignocellulosic material, rubber material, waste organic sludges, or mixtures thereof.

30. The solid-fuel product of claim 21, further comprising combustible reinforcing fibers selected from the group consisting of natural polymeric fibers, synthetic polymeric fibers, and mixtures thereof.

* * * * *